US006888132B1

(12) United States Patent
Sheehan et al.

(10) Patent No.: US 6,888,132 B1
(45) **Date of Patent: *May 3, 2005**

(54) REMOTE REAGENT CHEMICAL IONIZATION SOURCE

(76) Inventors: Edward W Sheehan, 655 William Pitt Way, Pittsburgh, PA (US) 15238; Ross C Willoughby, 655 William Pitt Way, Pittsburgh, PA (US) 15238

( * ) Notice: Subject to any disclaimer, the term of this patent is extended or adjusted under 35 U.S.C. 154(b) by 17 days.

This patent is subject to a terminal disclaimer.

(21) Appl. No.: 10/449,344

(22) Filed: May 30, 2003

Related U.S. Application Data

(60) Provisional application No. 60/384,864, filed on Jun. 1, 2002, and provisional application No. 60/384,869, filed on Jun. 1, 2002.

(51) Int. Cl.[7] ..... H01J 49/00
(52) U.S. Cl. ..... 250/288; 250/281; 250/286
(58) Field of Search ..... 250/288, 281, 250/286

(56) References Cited

U.S. PATENT DOCUMENTS

| | | | | |
|---|---|---|---|---|
| 4,209,696 | A | 6/1980 | Fite | |
| 4,531,056 | A | 7/1985 | Labowsky et al. | |
| 4,542,293 | A | 9/1985 | Fenn et al. | |
| 4,999,492 | A | 3/1991 | Nakagawa | |
| 5,412,208 | A | 5/1995 | Covey et al. | |
| 5,436,446 | A | 7/1995 | Jarrell et al. | |
| 5,559,326 | A | 9/1996 | Goodley et al. | |
| 5,747,799 | A | 5/1998 | Franzen | |
| 5,756,994 | A | 5/1998 | Bajic | |
| 5,965,884 | A | 10/1999 | Laiko et al. | |
| 6,060,705 | A * | 5/2000 | Whitehouse et al. | 250/288 |
| 6,207,954 | B1 | 3/2001 | Andrien et al. | |
| 6,239,428 | B1 | 5/2001 | Kunz | |
| 6,534,765 | B1 | 3/2003 | Robb et al. | |
| 6,610,986 | B2 | 8/2003 | Hartley | |

OTHER PUBLICATIONS

Potjewyd, J., "Focusing of ions in atmospheric pressure gases using electrostatic fields," Ph.D. Thesis, University of Toronto (1983).

Hartley, F.T. et al., "NBC detection in air and water," Micro/Nano 8, pp. 1, 2, and 8 (Dec. 2003).

* cited by examiner

*Primary Examiner*—John R. Lee
*Assistant Examiner*—Zia R. Hashmi

(57) ABSTRACT

An improved ion source for collecting and focusing dispersed gas-phase ions from a reagent source at atmospheric or intermediate pressure, having a remote source of reagent ions separated from a low-field sample ionization region by a stratified array of elements, each element populated with a plurality of openings, wherein DC potentials are applied to each element necessary for transferring reagent ions from the remote source into the low-field sample ionization region where the reagent ions react with neutral and/or ionic sample forming ionic species. The resulting ionic species are then introduced into the vacuum system of a mass spectrometer or ion mobility spectrometer. Embodiments of this invention are methods and devices for improving sensitivity of mass spectrometry when gas and liquid chromatographic separation techniques are coupled to atmospheric and intermediate pressure photo-ionization, chemical ionization, and thermospray ionization sources.

20 Claims, 3 Drawing Sheets

REMOTE REAGENT CHEMICAL IONIZATION SOURCE

CROSS-REFERENCE TO RELATED APPLICATIONS

This application claims the benefit of Provisional Patent Application Ser. No. 60/384,864, filed Jun. 1, 2002. This application is related to Provisional Application Ser. No. 06/210,877, filed Jun. 9, 2000, now application Ser. No. 09/877,167, filed Jun. 8, 2001; and Provisional Patent Application 60/384,869, filed Jun. 1, 2002, now application 10/449,147, filed May 31, 2003.

GOVERNMENT SUPPORT

The invention described herein was made in the course of work under a grant from the Department of Health and Human Services, Grant Number 1 R43 R143396-1.

BACKGROUND

1. Field of Invention

This invention relates to methods and devices for improved ionization, collection and focusing of ions generated from chemical and photo-ionization for introduction into the mass spectrometer and other gas-phase ion analyzers and detectors.

2. Description of Prior Art

The generation of ions at or near atmospheric pressure is accomplished by a variety of means; including, electrospray (ES), atmospheric pressure chemical ionization (APCI), atmospheric pressure matrix assisted laser desorption ionization (AP-MALDI), discharge ionization, $^{63}$Ni sources, inductively coupled plasma ionization, and photoionization. A general characteristic of these atmospheric or near atmospheric ionization sources is the dispersive nature of the ions once produced. Needle sources such as electrospray and APCI disperse Ions radially from the axis in high electric fields emanating from needle tips. Aerosol techniques disperse ions in the radial flow of gases emanating from tubes and nebulizers. Even desorption techniques such as atmospheric pressure MALDI will disperse ions in a solid angle from a surface. The radial cross-section of many dispersive sources can be as large as 5 or 10 centimeters in diameter.

As a consequence of a wide variety of dispersive processes, efficient sampling of ions from atmospheric pressure sources to small cross-sectional targets or through small cross-sectional apertures and tubes (usually less than 1 mm) into a mass spectrometer becomes quite problematic. This is particularly amplified if the source on ions is removed from the regions directly adjacent to the aperture.

The simplest approach to sampling dispersive atmospheric sources is to position the source on axis with a sampling aperture or tube. The sampling efficiency of simple plate apertures is generally less than 1 ion in 104. Devices developed by Fite (U.S. Pat. No. 4,209,696) used pinhole apertures in plates with electrospray. Devices developed by Laiko and Burlingame (W.O. Pat. No. 99/63576 and U.S. Pat. No. 5,965,884) used aperture plates with atmospheric pressure MALDI. An atmospheric pressure source by Kazuaki et al (Japan Pat. No. 04215329) is also representative of this inefficient approach. This general approach in severely restricted by the need for precise aperture alignment and source positioning, for example, in the case of an APCI source misalignment of the discharge needle can lead to very poor sampling efficiencies.

Recently, a photoionization source has been developed for LC/MS applications by Robb and coworkers (W.O. Pat. No. 01/33605 A2 and U.S. Pat. No. 6,534,765). The use of low field photo-ionization sources has lead to some improvement in sampling efficiency from atmospheric pressure sources, but these sources also suffer from a lower concentration of reagent ions when compared to traditional APCI sources.

A wide variety of source configurations utilize conical skimmer apertures in order to improve collection efficiency over planar devices. This approach to focusing ions from atmospheric sources is limited by the acceptance angle of the electrostatic fields generated at the cone. Generally, source position relative to the cone is also critical to performance, although somewhat better than planar apertures. Conical apertures are the primary inlet geometry for commercial ICP/MS with closely coupled and axially aligned torches. Examples of conical-shaped apertures are prevalent in ES and APCI (U.S. Pat. No. 5,756,994), and ICP (U.S. Pat. No. 4,999,492) inlets. As with planar apertures, source positioning relative to the aperture is also critical to performance; and collection efficiency is quite low.

Another focusing alternative utilizes a plate lens with a large hole in front of an aperture plate or tube for transferring sample into the vacuum system. The aperture plate is generally held at a high potential difference relative to the plate lens. The configuration creates a potential well that penetrates into the source region and has a significant improvement in collection efficiency relative to the plate or cone apertures. But, this configuration has a dear disadvantage in that the potential well resulting from the field penetration is not independent of ion source position, or potential. High voltage needles can diminish this well. Off-axis sources can affect the shape and collection efficiency of the well also. Optimal positions are highly dependent upon both flow (liquid and, concurrent and countercurrent gas flows) and voltages. They are reasonable well suited for small volume sources such as nanospray while larger flow sources become less efficient and problematic. Because this geometry is generally preferential over plates and cones, it is seen in most types of atmospheric source designs. We will call this approach the "Plate-Well" design which is reported with apertures by Labowsky et al. (U.S. Pat No. 4,531,056), Covey et al. (U.S. Pat. No. 5,412,209) and Franzen (U.S. Pat. No. 5,747,799). There are also many Plate-Well designs with tubes reported by Fenn et al. (U.S. Pat. No. 4,542,293), Goodley et al. (U.S. Pat. No. 5,559,326), and Whitehouse et al. (U.S. Pat. No. 6,060,705).

Several embodiments of atmospheric pressure sources have incorporated grids in order to control the sampling of gas-phase ions. Jarrell and Tomany (U.S. Pat. No. 5,436,446) utililized a grid that reflected lower mass ions into a collection cone and passed large particles through the grid. This modulated system was intended to allow grounded needles and collection cones or apertures, and float the grid at high alternating potentials. This device had limitations with duty cycle of ion collection in a modulating field (non-continuous sample introduction) and spacial and positioning restrictions relative to the sampling aperture. Andrien et al (U.S. Pat. No. 6,207,954 B1) used grids as counter electrodes for multiple corona discharge sources configured in geometries and at potentials to generated ions of opposite charge and monitor their interactions and reactions. This specialized reaction source was not configured with high field ratios across the grids and was not intended for high transmission and collection, rather for generation of very specific reactant ions. An alternative atmospheric pressure device by Yoshiaki (JP10088798) utilized on-axis hemispherical grids in the second stage of pressure reduction. Although the approach is similar to the present device in concept, it is severely limited by gas discharge that may occur at these low pressures if higher voltages are applied to the electrodes and the fact that most of the ions (>99%) formed at atmospheric pressure are lost at the cone-aperture from atmospheric pressure into the first pumping stage.

Grids are also commonly utilized for sampling ions from atmospheric ion sources utilized in ion mobility spectrometry (IMS). Generally, for IMS analysis ions are pulsed through grids down a drift tube to a detector as shown in Kunz (U.S. Pat. No. 6,239,428B1). Great effort is made to create a planar plug of ions in order to maximize resolution of components in the mobility spectrum. These devices generally are not continuous, nor do they require focusing at extremely high compression ratios.

SUMMARY

A preferred embodiment of the invention is the configuration of a high efficiency ionization source utilizing remote reagent ion generation coupled with a large reaction volume electro-optical well to facilitate efficient sample ionization and collection. The novelty of this device is the manner of isolation of the electric fields in the reagent ion generation region from the electric fields of the reaction or sample ionization region and the product ion-sampling or funnel region. This is accomplished through the utilization of a perforated and laminated surface that efficiently passes reagent ions from the reagent source region to the reaction region without significant penetration of the fields from the adjacent regions.

Objects and Advantages

One object of the present invention is to increase the collection efficiency of ions and/or charged particles at a collector, or through an aperture or tube into a vacuum system, by creating a very small cross-sectional area beam of ions and/or charged particles from highly dispersed atmospheric pressure ion sources. The present invention has a significant advantage over prior art in that the use of a Laminated High Transmission Element (L-HTE) to separate reagent ion generation from product ion formation and ion focusing allows precise shaping of fields in both regions. Ions can be generated in large ion source regions without losses to walls. Droplets have longer time to evaporate and/or desorb neutrals or ions without loss from the sampling stream. Source temperatures can be lower because rapid evaporation is not required. This can prevent thermal decomposition of some labile compounds. Counter electrodes for APCI needles do not have to be the plate lens as practices with most conventional sources or even the HTE (high transmission element, as described by Sheehan et al. U.S. patent application Ser. No. 09/877,167). The aerosol and plasma can be generated remotely and ions can be allowed to drift toward the HTE.

Another object of the present invention is to have collection efficiency be independent of ion source position. With the present invention there is no need for precise mechanical needle alignment or positioning relative to collectors, apertures, or tubes invention. Ions generated at any position in the reaction and product ion-sampling regions are transmitted to the collector, aperture, or tube with similar efficiency. No existing technology has positional and potential independence of the source. The precise and constant geometry, and alignment of the focusing well with sampling apertures will not change with needle placement. The electric fields inside the reaction, product ion-sampling, and deep-well regions (focusing side) will not change, even if they change outside (reagent ion source side).

Another object of the present invention is the independence of ion source type. This device is capable of transmission and collection of ions from any atmospheric (or near atmospheric) pressure ionization source; including, atmospheric pressure chemical ionization, inductively coupled plasma, discharge sources. $Ni^{63}$ sources, spray ionization sources, induction ionization sources and photoionization sources. The device is also capable of sampling ions of only one polarity at a time, but with extremely high efficiency.

Another object of the present invention is to efficiently collect and/or divert a flow of ions from more than one source. This can be performed in a simultaneous fashion for introduction of mass calibrants from a separate source and analytes from a different source at a different potential; conversely, it can be performed sequentially as is typical with multiplexing of multiple chromatographic streams introduced into one mass spectrometer.

Another object of the present invention is to efficiently transmit ions to more than one target position. This would have the utility of allowing part of the sample to be collected on a surface while another part of the sample is being introduced through an aperture into a mass spectrometer to be analyzed.

Another object of the present invention is to improve the efficiency of multiplexed inlets from both multiple macroscopic sources and microchip arrays, particularly those developed with multiple needle arrays for APCI. Position independence of this invention make it compatible with a wide variety of needle array technologies.

Another object of the present invention is to remove larger droplets and particles from aerosol sources with a counterflow of gas to prevent contamination of deep-well lens, funnel aperture wall, apertures, inlets to tubes, vacuum components, etc.

One major advantage of the present device is the capability of generating a large excess of reagent ions In a remote region and then introducing the reagent ions into the reaction region to drive the equilibrium of the reaction far toward completion.

The reaction volume could literally be 100's of $cm^3$, not incurring sampling losses associated with conventional sources.

Another advantage of this source is the ability for neutrals and reagent ions to reside in the reaction funnel region, in the presence of low electrostatic fields, for relatively long durations [even in a large volume]; allowing even reactions with very slow reaction kinetics to proceed toward completion.

Another advantage of the present device is the ability to utilize the tremendous compression capabilities of funnel-well optics to compress all ions generated in the reaction and funnel regions into a small cross-sectional area.

One of the most important advantages of the remote reagent ion source when compared to convention APCI sources is the lack of recombination losses, from, for example, stray electrons; with the extraction of reagent of one polarity ions out of a plasma and transport into the reaction region. In this device there are not recombination losses in the reaction region.

DRAWING FIGURES

REFERENCE NUMBERS IN DRAWINGS

| | |
|---|---|
| 10 sample source | 50 product ion-sampling or funnel region |
| 12 sample delivery means or line | 52 reaction or sample ionization region |
| 14 nebulizer | 54 equipotential lines |
| 20 nebulization gas source | 56 sample ion trajectories |
| 30 nebulizer heating supply | 58 funnel aperture |
| 32 heating coils | 60 exhaust outlet |
| 34 sample aerosol flow | 62 exhaust destination |
| 36 ion source entrance wall | 64 inner high transmission electrode |
| 40 reagent ion generation region | 66 outer high transmission electrode |
| 41 high voltage supply | 70 deep-well region |
| 42 discharge needle | 72 deep-well lens |
| 44 reagent ion source region | 74 deep-well insulator ring |
| 45 lamp | 76 exit aperture |
| 46 reagent ion trajectories | 78 funnel aperture wall |
| 48 reagent gas source | 80 ion collection region |

DESCRIPTION

Figure 1:
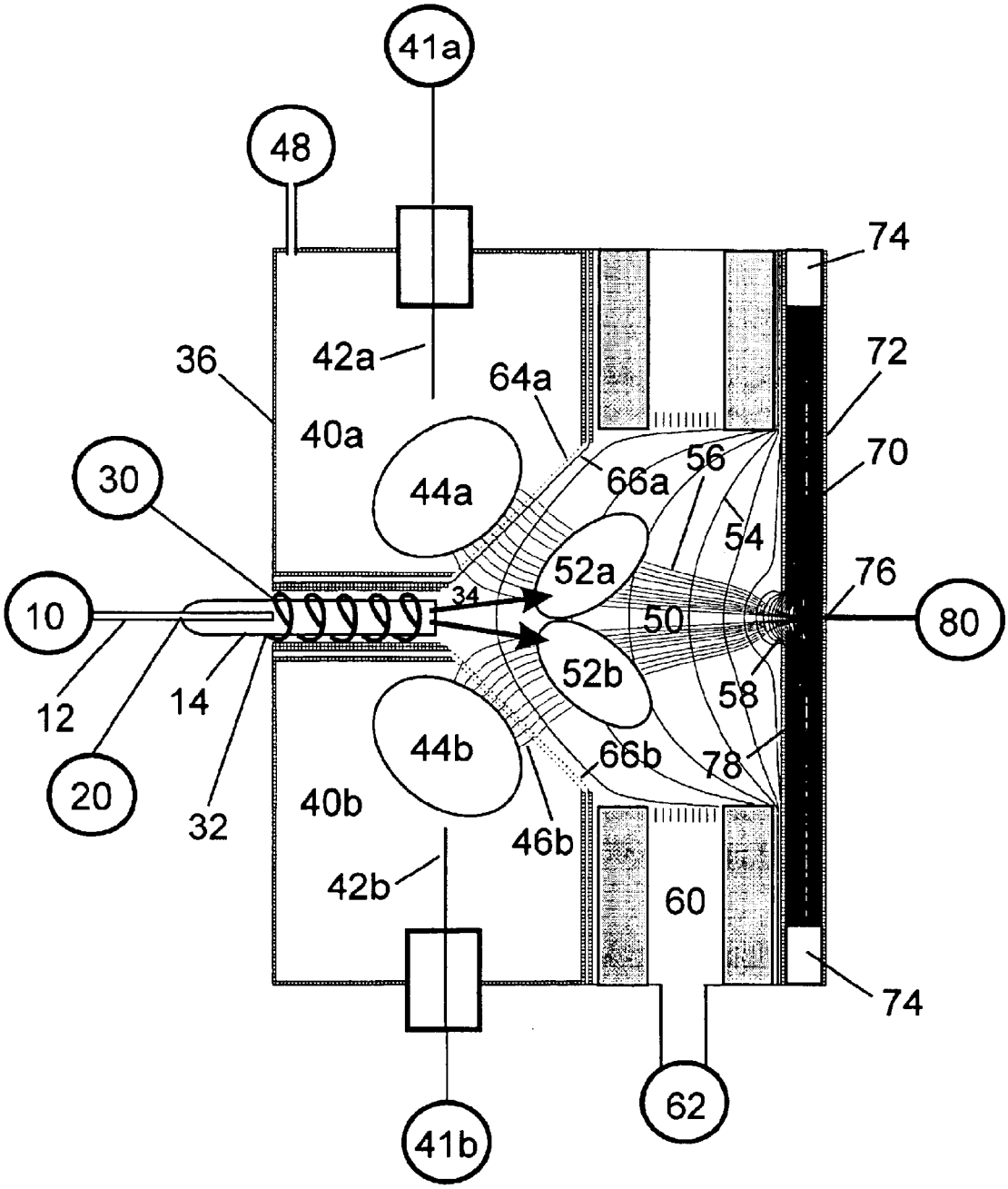
FIG. 1 is a cross-sectional illustration of a remote reagent ion generation source for atmospheric pressure chemical ionization (APCI).

Preferred Embodiment—FIG. 1

(Remote Atmospheric Pressure Chemical Ionization, Remote-APCI)

A preferred embodiment of the chemical ionization source of the present invention at atmospheric pressure is illustrated in FIG. 1. Sample from a sample source 10 is delivered to a nebulizer 14 by a sample delivery means 12 through an ion source entrance wall 36. This embodiment contains a heated nebulizer for nebulization and evaporation of sample streams emanating from liquid chromatographs and other liquid sample introduction devices. The liquid sample is heated, nebulized, and vaporized by the input of nebulization gas from a nebulization gas source 20 and by heat from heating coils 32 generated from a nebulizer heating supply 30. The nebulizer generates a sample aerosol flow 34 with the sample being vaporized into the gas-phase and proceeding into a reaction or sample ionization region 52.

Reagent ions are generated in a reagent ion generation region 40 by electron ionization from a discharge needle 42. The voltage applied to the discharge needles is supplied from a high voltage supply 41. Reagent gas is supplied to region 40 from a reagent gas source 48. In this preferred embodiment, reagent ions are generated in more than one region in the annular space around the sample ionization regions 52*a* and 52*b*; these multiple regions are designated 40*a* and 40*b*. Each region 40*a*, 40*b* has an associated discharge needle 42*a*, 42*b*, respectively.

With DC potentials applied to the discharge needle 42*a*, 42*b*; a planar laminated high-transmission element (as described in our patent, U.S. patent application Ser. No. 10/449,147) consisting of an inner high-transmission electrode or just inner-HT electrode 66*a*, 66*b* and an outer high-transmission electrode or just outer-HT electrode 66*a*, 54*b* populated with slotted openings (not shown); a funnel aperture wall 78; and a deep-well lens 72. Approximately lens 72 approximately all of the reagent ions generated in a reagent ion source region 44*a*, 44*b* take on a series of reagent ion trajectories 46*a*. 46*b* as they flow from regions 40*a*, 40*b*, through the inner-64*a*, 64*b* and outer-HT electrodes 66*a*, 66*b* and into the product ion sampling or funnel region 50; where the reagent ions undergo ion-molecule reactions with the sample, delivered to region 50 from source 10, to make gas-phase sample ions in sample ionization region 52*a*, 52*b*.

Under the influences of the applied DC potentials on the elements, walls, and lenses; approximately all of the gas-phase ions in region 50, including reagent and sample ions, take on a series of ions trajectories 56 and are focused through the funnel aperture 58 in the funnel aperture wall 78, into a deep-well region 70 through an exit aperture 76 in the deep-well lens 72 into the ion collection region 80. The deep-well lens 72 is isolated from the funnel aperture wall 78 by a deep-well insulator ring 74.

Aperture 76 has a diameter appropriate to restrict the flow of gas into region 80. In the case of vacuum detection, such as mass spectrometry in region 80, typical aperture diameters are 100 to 1000 micrometers. The collection region 80 in this embodiment is intended to be the vacuum system of a mass spectrometer (interface stages, optics, analyzer, detector) or other low-pressure ion and particle detectors.

Excess sample and reagent gases in region 50 are exhausted through a exhaust outlet 60 and delivered to an exhaust destination 62.

Figure 2:
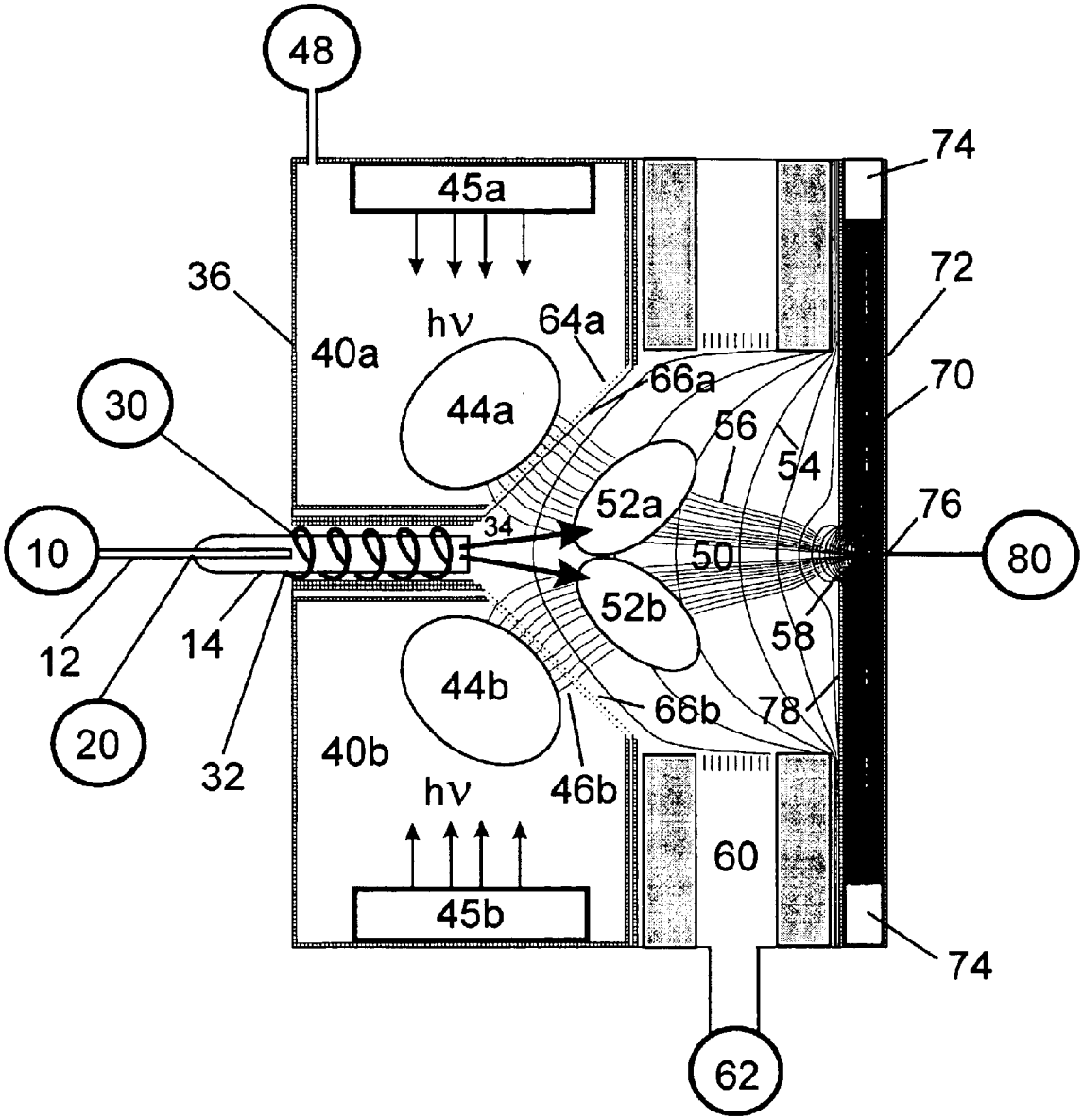
FIG. 2 is a cross-sectional illustration of a remote reagent ion generation source for atmospheric pressure photoionization (APPI).

Additional Embodiment—FIG. 2

(Remote Atmospheric Pressure Photo-Ionization, Remote-APPI)

An additional embodiment is shown in FIG. 2; an atmospheric pressure chemical ionization source where photo-ionization is used to generate reagent ions. The only distinguishing component of this embodiment that varies from the previous embodiment shown in FIG. 1 is that the high voltage supply 41 and discharge needle 42 are replaced by a lamp 45 to supply photons required to facilitate photo-ionization in regions 40*a*, 40*b*. In this case, multiple lamps 45*a*, 45*b* are used to create photo-reagent ions in multiple source regions 44*a*, 44*b* located in the annular space around the sample ionization region 52*a*, 52*b*. Organic dopants, such as but limited to benzene, toluene, or acetone can be added to the reagent ionization region 40*a*, 40*b* from source 48 along with any other gases from source 48.

Figure 3:
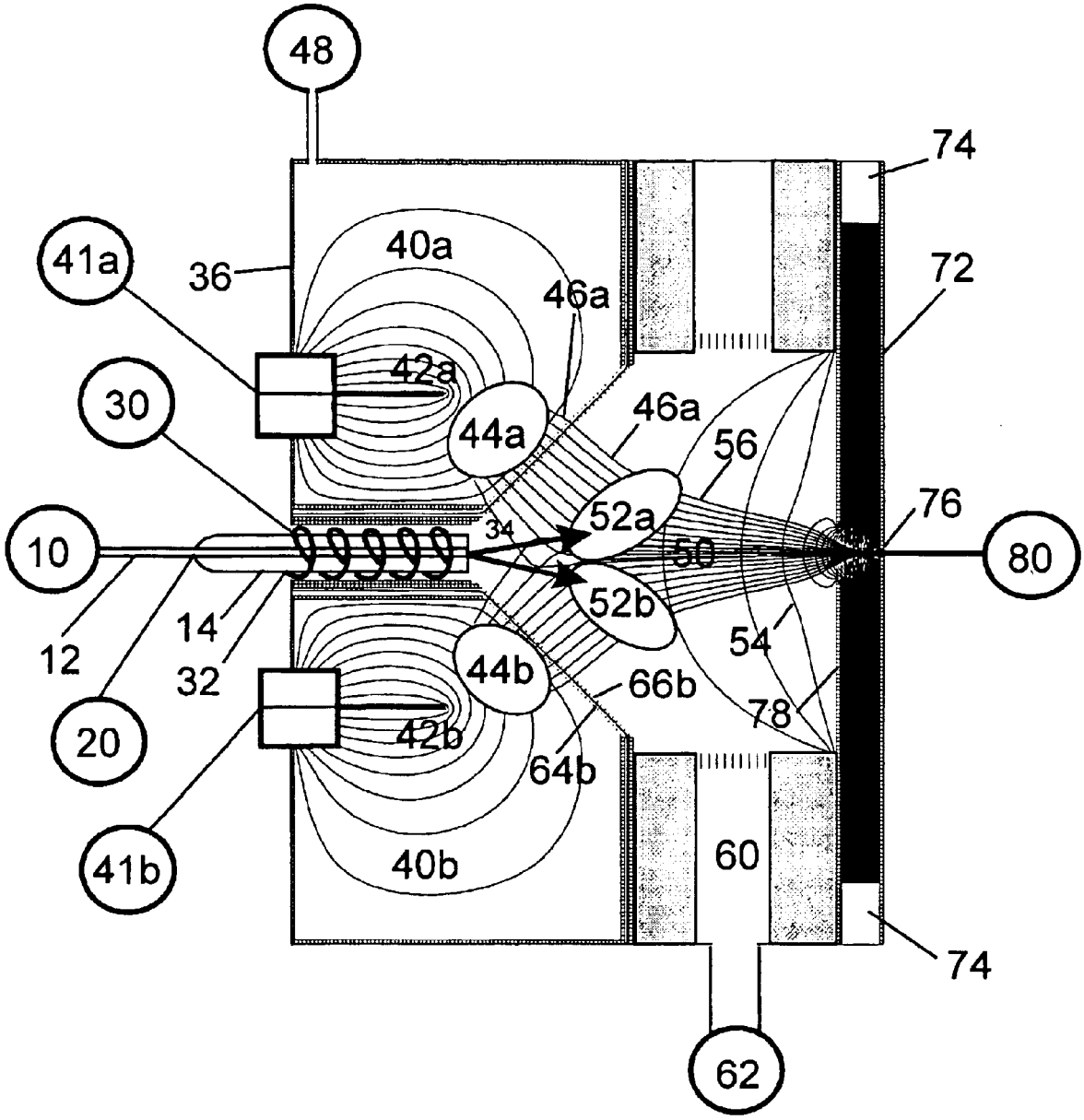
FIG. 3 is a cross-sectional illustration of a remote reagent ion generation source for a lower-pressure chemical ionization (CI) source.

Alternative Embodiment—FIG. 3

(Chemical Ionization and Thermospray)

There are various possibilities with regard to the type of sample and pressure regime at which the chemical ionization source is operated, as illustrated in FIG. 3. FIG. 3 shows a source, at atmospheric or less than atmospheric pressure, with the sample being delivered through the sample delivery line 12 is a gas, where the sample source 10 is a gas chromatograph, or is a liquid and the nebulizer 14 is a thermospray nebulizer where the sample source is a liquid chromatograph. Gases in the reaction region 50 are removed by a mechanical pump in gas destination 62 to maintain the reaction region at atmospheric or lower pressures.

Operation—FIGS 1, 2, 3

The manner of using the source to ionize gas-phase molecular species is similar to that for sources in present use. Namely, gas-phase reagent ions are generated in a region 40 adjacent to the sample ionization region 52, by means of a corona discharge, such as but not limited to atmospheric pressure ionization, atmospheric pressure chemical ionization, etc. Alternatively, reagent ions can also be formed by the process of photoionization, whereby the gas or gases in the reagent ion generation region 40 undergoes photoionization by light emitted from the lamp 45. Reagent ions in the region 44 are attracted to the laminated high-transmission element (64, 66) by an electric potential difference between the source region 40 and the potential of the inner-HT electrode 64. The reagent ions moving toward the inner-HT electrode are diverted away from the conducting surface of electrode 64 and focused into the openings in the laminated high-transmission electrode (64, 65) due to the field lines emanating from the outer-HT electrode 66 through the openings into the reagent ion source region 44 causing approximately all of the ions to flow through the openings and out into the the field penetrates into region 44 is due to the potential difference between the inner-and outer-HT electrodes 64, 66, respectively, being relatively high.

The sample, composed of neutral or ionic aerosols or both, is introduced into the reaction region 52 where the components of the sample interact with the reagent ions moving through this region, forming ionic species from the sample components. New ionic species formed from the interaction of reagent ions and sample aerosol and any other remaining ionic species in regions 50, 52 are accelerated away from the funnel region 50 and focused through the funnel aperture 58 into the deep-well region 70 where a well collimated and highly compressed beam of ions is delivered to the exit aperture 76 for transfer into the ion collection region 80 where the collection region is the vacuum system of a mass spectrometer or any other low-pressure ion or particle detector.

Gases from the reagent ion generation region 40 that have passed through the laminated high-transmission element and gases from the sample source 10 that have flowed into region 50 are at least partially removed from the funnel region through the exhaust outlet 60.

FIG. 3 shows a source where the sample is introduced by spraying a liquid by means of a thermospray nebulizer or alternatively a gas from a gas chromatograph. A mechanical vacuum pump in the exhaust destination 62 maintains the pressure in the reaction region 50 to as low as 100 millitorr. In this pressure regime (typically in the 10 torr range) care must be taken to avoid discharge from occurring in region 50.

CONCLUSION RAMIFICATIONS, AND SCOPE

Although the description above contains many specifications, these should not be construed as limiting the scope of the invention but as merely providing illustrations of some of the presently preferred embodiments of this invention. For example the sample can be introduced off-axis or orthogonal to the funnel region; the laminated high-transmission element can have other shapes; the number of laminates of the laminated high-transmission element can vary depending on the source of ions, the type of ion-collection region or a combination of both, etc.

Thus the scope of the invention should be determined by the appended claims and their legal equivalents, rather than by the examples given.

We claim:

1. A chemical ionization apparatus for the collection and focusing of gas-phase ions produced from chemical species, the apparatus comprising:

a. a dispersive source of gas-phase reagent ions operated substantially at atmospheric pressure;

b. a sample introduction means operated substantially at atmospheric pressure, wherein said means is a heated conduit for the introduction of said chemical species as gaseous substances or an aerosol;

c. a reaction region receiving the outlets of said sample introduction means and said reagent ion source, which are arranged so that said gaseous substances emitted from said sample introduction means and said reagent ions from said reagent ion source interact forming gas-phase ionic chemical species;

d. an analyzer chamber exposed to a high vacuum downstream of said reaction region, for receiving said gas-phase reagent ions and ionic chemical species;

e. a first laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates; and f. a second laminated lens sandwiched between said reaction region and said analyzer chamber, said second laminated lens having a central opening through which substantially all said gas-phase ions unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said underside of said second insulating body is adjacent to said analyzer chamber forming a deep-well region between said metal laminates of second laminated lens, said second set of metal laminates being supplied with attracting electrostatic potentials by connection to a voltage supply, and generating an electrostatic field between said reaction region and said second set of metal laminates, wherein said region of reagent ion generation is physically separated from ion reaction region.

2. A chemical ionization apparatus as defined in claim 1, further comprising:

a. an exhaust outlet downstream of said reaction region and upstream of second laminated lens for drawing non-ionic gaseous substance away from said ionic chemical species and reagent ions; and b. valve means for controlling the out-flow of gas to maintain substantially atmospheric pressure within the reaction region.

3. A chemical ionization apparatus as defined in claim 1, wherein said central opening in said metal laminate on said topside of second laminated lens is larger than said central opening of said metal laminate on said underside of said second laminated lens forming a deep well ion-funnel having an entry at said larger opening and an exit at said smaller opening wherein substantially all said gas-phase ions in said reaction region pass unobstructed through said deep well ion-funnel and exit through said exit into said analyzer chamber.

4. A chemical ionization apparatus as defined in claim 1, wherein said analyzer chamber is occupied by a mass spectrometer; and associated transfer ion optics and radio frequency (RF) multi-Dole devices.

5. A chemical ionization apparatus as defined in claim 4, wherein said mass spectrometer is a quadrupole mass analyzer.

6. A chemical ionization apparatus as defined in claim 4, wherein said mass spectrometer is a time-of-flight, quadrupole, ion trap mass analyzer, or a combination thereof.

7. A chemical ionization apparatus as defined in claim 1, comprising connective means for being affixed directly to the housing of said analyzer chamber.

8. A chemical ionization apparatus as defined in claim 1, said sample introduction means is on-axis with said first laminated lens wherein said reagent ions interact with said gaseous substances emitted from said sample introduction means in said reaction region which is upstream of second laminated lens.

9. A chemical ionization apparatus as defined in claim 1, wherein said gas-phase reagent ions are formed by discharge ionization whereby said gas-phase reagent ions are derived from gaseous components in said reaction region.

10. A chemical ionization apparatus as defined in claim 1, wherein said gas-phase reagent ions are formed by photo-ionization whereby said gas-phase reagent ions are derived from gaseous components in said reaction region.

11. A chemical ionization apparatus as defined in claim 1, wherein said sample introduction means is the outlet of a gas chromatograph whereby said gas chromatograph introduces non-ionic or neutral gaseous chemical species into said reaction region.

12. A chemical ionization apparatus as defined in claim 1, wherein said sample introduction means is the outlet of a liquid chromatograph, liquid containing a solvent and molecule(s) of interest for detection or analysis wherein said molecule(s) of interest are volatile, non-volatile or ionic or thermally labile or a combination thereof.

13. A chemical ionization apparatus as defined in claim 1, wherein said sample introduction means is a thermospray nebulizer at or below atmospheric pressure for vaporizing a solution containing a solvent and molecule(s) of interest for detection or analysis wherein said molecule(s) of interest are non-volatile or ionic or thermally labile or a combination thereof.

14. A chemical ionization apparatus as defined in claim 1, wherein said sample introduction means is a thermal pneumatic nebulizer for vaporizing a solution containing a solvent and molecule(s) of interest for detection or analysis wherein said molecule(s) of interest are non-volatile or ionic or thermally labile or a combination thereof.

15. An atmospheric pressure chemical ionization apparatus for the production of gas-phase ions or highly charged aerosols produced from chemical species, the apparatus comprising:

a. a dispersive source of gas-phase reagent ions operated substantially at atmospheric pressure;

b. a sample introduction means operated substantially at atmospheric pressure, wherein said means is a heated conduit for the introduction of said chemical species as gaseous substances or an aerosol;

c. a reaction region receiving the outlets of said sample introduction means and said reagent ion source, which are arranged so that said gaseous substances emitted from said sample inlet and said reagent ions or aerosols from said reagent ion source interact forming gas-phase ionic species; and d. a laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates.

16. An atmospheric pressure chemical ionization apparatus for the production of gas-phase ions or highly charged aerosols as claimed in claim 15, further comprising:

a. an analyzer chamber exposed to a high vacuum downstream of said reaction region, for receiving substantially all said gas-phase ions or highly charged aerosols;

b. a second laminated lens sandwiched between said reaction region and said analyzer chamber, said second laminated lens having a central opening through which substantially all said gas-phase ions or aerosols pass unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said top-side has an entry aperture, said metal laminate on said underside of said second insulating body is adjacent to said analyzer chamber, said metal laminate on said under side has an exit aperture, said second set of metal laminates being supplied with attracting electrostatic potentials by connection to a voltage supply, and generating an electrostatic field between said reaction region and said second set of metal laminates, whereby substantially all said gas-phase ions in reaction region pass through said entry and exit apertures of second laminated lens into said analyzer chamber.

17. A method for producing gas-phase ions from an atmospheric pressure chemical ionization apparatus, said method comprising:

a. forming gas-phase reagent ions in a dispersive source operated substantially at atmospheric pressure;

b. providing electrostatic attraction to said gas-phase reagent ions with electrostatic fields provided by a laminated lens, said laminated lens having an ion drawing potential, such that electrostatic field lines between said source of reagent ions and metal laminates on the topside and underside of said laminated lens are concentrated on said metal laminate on said top side of said laminated lens;

c. transmitting substantially all said gas-phase reagent ions through said laminated lens by allowing the unobstructed passage by providing a plurality of holes in said laminated lens with a low depth aspect ratio, a high openness aspect ratio, and a high electrostatic potential ratio between said metal laminates on the topside and underside of said laminated lens;

d. supplying a gaseous or liquid sample containing molecules to a heated sample introduction means at substantially atmospheric pressure for emitting molecules in said sample as gas-phase molecules; and e. receiving said gas-phase molecules from said introduction means and said gas-phase reagent ions from said reagent ion source in a reaction region at substantially atmospheric pressure where said gas-phase molecules react with said reagent ions forming gas-phase ionic chemical species.

18. A method for producing gas-phase ions from an atmospheric pressure chemical ionization apparatus as claimed in claim 17 which further includes the step of providing an electrostatic attraction to said gas-phase ions in said reaction region with a electrostatic field generated by a second laminated lens, said second laminated lens having an ion-drawing potential such that electrostatic field lines between said reaction region and metal laminates on the topside and underside of said second laminated lens are concentrated into a central opening in said second laminated lens urging said gas-phase ions in said reaction region to be directed towards and through said central opening whereby substantially all said gas-phase ions flow into a analyzer chamber.

19. A method for producing gas-phase ions from an atmospheric pressure chemical ionization apparatus as claimed in claim 18 which further includes a mass spectrometer in said analyzer chamber for detecting said gas-phase ions.

20. A method of vaporizing a liquid sample containing solvent and molecules of interest for an atmospheric pressure chemical ionization apparatus, said method comprising:

a. introducing said liquid sample into a heated sample introduction means at substantially atmospheric pressure for emitting said solvent and said molecules of interest as gas-phase molecules;

b. receiving said gas-phase molecules from said heated sample introduction means in a reaction region at substantially atmospheric pressure;

c. forming gas-phase reagent ions in a dispersive source operated substantially at atmospheric pressure;

d. providing electrostatic attraction to said gas-phase reagent ions in said dispersive source with electrostatic fields provided by a laminated lens, said laminated lens having an ion drawing potential, such that electrostatic field lines between said dispersive source of reagent ions and metal laminates on the topside and underside of said laminated lens are concentrated on said metal laminate on said top side of said laminated lens;

e. transmitting said reagent ions through said laminated lens into said reaction region allowing the unobstructed passage by providing a plurality of holes in said laminated lens with a low depth aspect ratio, a high openness aspect ratio, and a high electrostatic potential ratio between said metal laminates on the topside and underside of said laminated lens;

f. receiving said gas-phase molecules from said heated sample introduction means and said gas-phase reagent ions from said reagent ion source in said reaction region at substantially atmospheric pressure where said gas-phase molecules react with said reagent ions forming gas-phase ionic chemical species;

g. providing electrostatic attraction to said substantially all gas-phase ions in said reaction region with electrostatic fields provided by a second laminated lens, said second laminated lens having an ion drawing potential, such that electrostatic field lines between said reaction region and metal laminates on the topside and underside of said laminated lens are concentrated into a central opening of said second laminated lens and;

h. transmitting substantially all said gas-phase ions in said reaction region through said second laminated lens into an analyzer chamber by allowing the unobstructed passage through said central opening, said central opening having an entry and exit, with a low depth aspect ratio, a high openness aspect ratio, and a high electrostatic potential ratio between said metal laminates on the topside and underside of said second laminated lens, wherein said ions exit said opening and are analyzed by means of mass spectrometry or ion mobility.

* * * * *

UNITED STATES PATENT AND TRADEMARK OFFICE

CERTIFICATE OF CORRECTION

PATENT NO. : 6,888,132 B1
DATED : May 3, 2005
INVENTOR(S) : Sheehan et al.

It is certified that error appears in the above-identified patent and that said Letters Patent is hereby corrected as shown below:

Column 4,
Line 34, change the word "In" to -- in --.

Column 5,
Line 57, delete the phrase "lens 72 approximately" before the word "all".

Column 8,
Line 64, change the word "multi-Dole" to -- multi-pole --.

Signed and Sealed this

Twenty-second Day of November, 2005

JON W. DUDAS
*Director of the United States Patent and Trademark Office*